US006581996B1

(12) United States Patent
Fromelius

(10) Patent No.: US 6,581,996 B1
(45) Date of Patent: Jun. 24, 2003

(54) LIFTING SYSTEM FOR USE IN HOISTING, PARTICULARLY HEAVY CAST PANELS

(76) Inventor: Lawrence Fromelius, 5611 Walnut, Downers Grove, IL (US) 60532

( * ) Notice: Subject to any disclaimer, the term of this patent is extended or adjusted under 35 U.S.C. 154(b) by 0 days.

(21) Appl. No.: 09/558,788

(22) Filed: Apr. 26, 2000

Related U.S. Application Data

(60) Provisional application No. 60/131,133, filed on Apr. 27, 1999.

(51) Int. Cl.[7] ..... E02D 35/00

(52) U.S. Cl. ..... 294/89; 294/82.1; 52/125.1; 52/704

(58) Field of Search ..... 294/89, 67.2, 67.22, 294/82.33, 82.34, 82.1; 52/125.2, 125.4, 125.5, 704, 708, 125.1

(56) References Cited

U.S. PATENT DOCUMENTS

| | | | | | |
|---|---|---|---|---|---|
| 2,422,839 | A | * | 6/1947 | Maskey | 294/82.24 |
| 2,842,822 | A | * | 7/1958 | Bennett | 294/82.1 |
| 2,886,370 | A | * | 5/1959 | Liebert | 294/82.1 |
| 3,610,674 | A | * | 10/1971 | Janssen | 294/82.33 |
| 4,173,856 | A | * | 11/1979 | Fricker | 52/125 |
| 4,367,892 | A | | 1/1983 | Holt | 294/89 |
| 4,386,486 | A | * | 6/1983 | Holt et al. | 52/125.5 |
| 4,437,272 | A | * | 3/1984 | Johnson | 52/125.5 |
| 4,603,522 | A | * | 8/1986 | Johnson | 52/125.4 |
| 4,627,198 | A | | 12/1986 | Francies, III | 52/125.5 |
| 4,700,979 | A | | 10/1987 | Courtois et al. | 294/89 |
| 4,708,086 | A | * | 11/1987 | Brown, Jr. | 114/294 |
| 4,821,994 | A | | 4/1989 | Fricker | 249/91 |
| 4,899,978 | A | * | 2/1990 | Gates | 249/219.2 |
| 5,197,255 | A | * | 3/1993 | Fricker | 52/703 |
| 5,226,265 | A | | 7/1993 | Kelly et al. | 52/125.6 |
| 5,244,243 | A | * | 9/1993 | Grayson et al. | 294/89 |
| 5,490,702 | A | * | 2/1996 | Fleming | 294/97 |
| 5,596,846 | A | * | 1/1997 | Kelly | 52/125.2 |
| 5,613,721 | A | * | 3/1997 | Mullius | 294/82.1 |
| 5,857,296 | A | * | 1/1999 | Niday et al. | 52/125.1 |
| 6,092,849 | A | * | 7/2000 | Zambelli et al. | 294/89 |
| 6,138,975 | A | * | 10/2000 | McDaid | 410/111 |

* cited by examiner

*Primary Examiner*—Christopher P. Ellis
*Assistant Examiner*—Paul T. Chin
(74) *Attorney, Agent, or Firm*—Baniak Pine & Gannon

(57) ABSTRACT

A lifting system for hoisting heavy pre-cast panels includes an anchor-lifting device permanently secured within a connection recess formed in the panel, and a connecting apparatus that attaches to the anchor-lifting device. The anchor-lifting device presents a laterally disposed connection pin for attachment to a pair of laterally spaced lifting hooks that form the connecting apparatus.

10 Claims, 2 Drawing Sheets

LIFTING SYSTEM FOR USE IN HOISTING, PARTICULARLY HEAVY CAST PANELS

This application claims the benefit of provisional application No. 06/131,133, filed Apr. 27, 1999.

BACKGROUND ON THE INVENTION

1. Field of the Invention

The present invention relates to lifting systems and more particularly to apparatus for lifting pre-cast concrete panels, wherein a part of the lifting apparatus is to be permanently embedded in a cast concrete panel member and is used in conjunction with an engineered lifting hook.

2. Background of the Prior Art

Prestressed, pre-cast concrete panels enjoy great popularity within the building and construction industry. They currently comprise the major component in the construction of many different kinds of structures, such as office buildings, warehouses, schools, parking decks, retention walls, etc. These pre-cast panels are typically fabricated offsite, that is, they are manufactured at a location other than the actual construction site. Most often the offsite manufacturing facility is a factory especially dedicated to producing concrete panels of various types and configurations. Obviously, the large heavy panels manufactured off-site must be loaded on vehicles and then moved to the construction site. Once at the construction site, the panels must be unloaded and placed in their final position relative to the construction.

Referring now to FIG. 1A, depicted is a commonly used prestressed concrete panel member 10 (only a portion of which is depicted) of the type to which the present invention pertains in particular. The concrete panel is manufactured such that during the casting process, an anchor plate of the type depicted in FIG. 1B at 11, is suspended within the concrete matrix in a structurally sound location in order to present cable-lifting holes which will ultimately receive cables for lifting the panel. Such anchor plates are typically positioned throughout a common side of the panel because the weight of even a small concrete panel necessitates that a number of anchoring devices be used to equally distribute the weight, and facilitate safe and precise handling of the finished panels.

Referring to FIGS. 1B through 1D, alternative prior art anchor plates which are similar to plate 11, are depicted at 12 and 13, and are referenced in U.S. Pat. No. 4,627,198 to Francies, which issued in 1986. In FIG. 1E, depicted at 14 is an apparatus for quickly connecting lifting cables to one of the prior art anchor plates and which is capable of repeated use. The various prior art lifting components 11, 12, 13, and 14, shown in FIGS. 1B through 1E, represent the most popular lifting components being utilized today in the lifting and handling of heavy concrete panels. These devices generally provide a secure means of attaching the lifting cables to the concrete panel, while providing a degree of manufacturing convenience and flexibility.

However, when referring again to FIG. 1A, it is seen that the connection recess 17 surrounding the anchor plate 11, makes plate 11 vulnerable to inaccessibility under certain conditions. The foremost problem is blockage of the cable connecting hole that is formed in the anchor plate as a result of water that collects and freezes in the recessed area. During periods of inclement weather, the entire recess, as well as the hole in the anchor plate 11, must either be covered or else it will have to be cleared of frozen material before the lifting cables can be secured within the connection hole. This condition manifests itself as a major inconvenience. Furthermore, the cable connection apparatus 14 that was shown in FIG. 1E is usually used with the anchor plate 11, and that apparatus represents an additional source of potential malfunction and inconvenience due to the device being designed with a rotating spoon-shaped connecting member, as described in U.S. Pat. No. 4,700,979, issued to Courtois et al., in 1987. In the Courtois patent, the cable connecting member is contained within and made a part of a mechanism comprised of a plurality of moving parts, namely a housing, a connecting member, and a retaining pin or shaft. The connecting member rotates or pivots with respect to the shaft, making the design particularly susceptible to wear, inadequate lubrication, rust, abuse, ice, and/or snow.

Although the prior art anchoring plates 11 through 13 have been used without the connecting apparatus 14 of FIG. 1E, or some other analogous quick-connect device, one the greatest downsides of plates 11 through 13, is the numerous manufacturing steps that are required in their fabrication, each step resulting in added costs. Additionally, each design is highly specific to only one particular type of cast panel that it will reside within. In addition, the connection apparatus 14 also requires numerous manufacturing steps.

Thus, all of the above-mentioned prior art anchoring plates, as well as the connection apparatus now being used, suffer from the following disadvantages: the anchor plate connection hole is vulnerable to inaccessibility under inclement weather when freezing occurs; the connection hole usually requires cleaning of frozen material (ice, mud) before the connection apparatus can be secured within the connection hole; the connection apparatus suffers vulnerability to seizing due to ice formation in the mechanism; the anchoring plates require numerous manufacturing steps, specifically notching, punching and drilling steps; the connection apparatus is composed of moving parts which can render the entire unit useless if one of the parts fails; the connection apparatus is particularly susceptible to wear, and is overly complex for the application and expensive to manufacture. Accordingly, it would be desirable to provide a lifting system which would improve upon the technology described above.

SUMMARY OF THE INVENTION

One aspect of the invention provides a lifting system which has found particular application for use with pre-cast panels having at least one surface which includes, in a preferred form, a connection recess formed therein, the invention comprising an anchor-lifting device fixed within the connection recess of the pre-cast panel, the anchor-lifting device including at least one connection pin, and a connecting apparatus for engagement with the connection pin to lift the pre-cast panel. The lifting system may also most advantageously include a connection apparatus that is comprised of an engineered lifting hook having a pair of laterally spaced individual hooks, each of which are joined together by a shared coupler and stop plate. The respective hooks also may define an engagement channel which defines a lifting arm. The lifting arm holds the connection pin within the engagement channel during lifting of the pre-cast panel.

The foregoing and other features and advantages of the invention will become further apparent from the following detailed description of the presently preferred embodiments, read in conjunction with the accompanying drawings. The detailed descriptions and drawings are merely illustrative of the invention rather than limiting, the scope of the invention being defined by the appended claims and equivalents thereof.

DETAILED DESCRIPTION OF A PREFERRED EMBODIMENT

Figure 2:
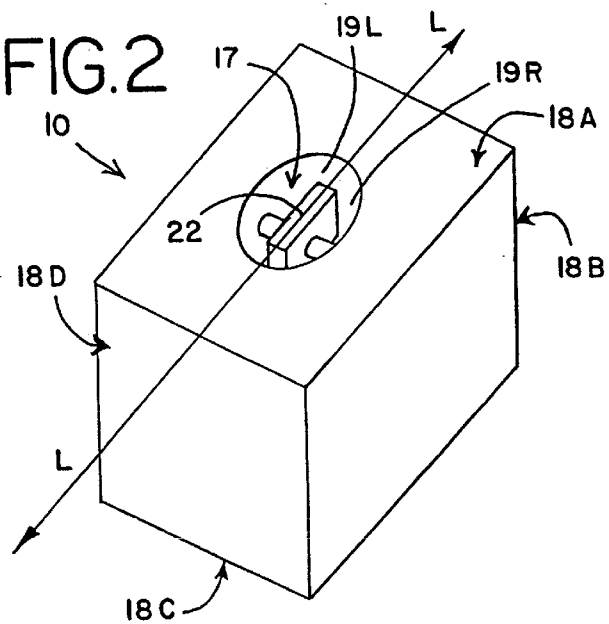
FIG. 2 is an isometric view of a concrete panel with an anchor-lifting device of the present invention permanently secured therein.
Figure 1E:
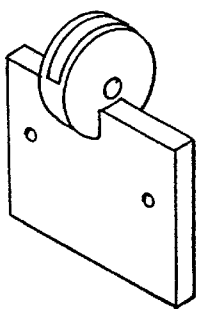
FIG. 1E PRIOR ART
FIG. 1E is still another prior art anchor plate and a prior art cable connection apparatus connected to the anchor plate.
Figure 1D:
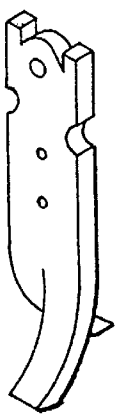
FIG. 1D PRIOR ART
FIG. 1D is still another type of prior art anchor plate.
Figure 1C:
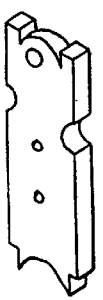
FIG. 1C PRIOR ART
FIG. 1C is another type of prior art anchor plate.
Figure 1B:
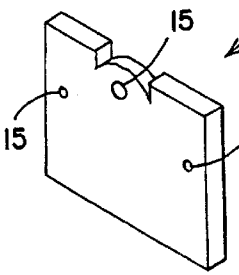
FIG. 1B PRIOR ART
FIG. 1B is an isometric view of the prior art anchor plate shown in FIG. 1.
Figure 1A:
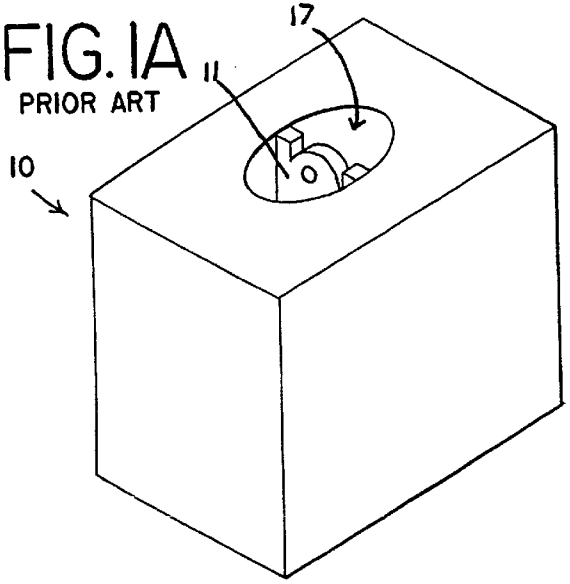
FIG. 1A PRIOR ART
FIG. 1A is an isometric view of a concrete panel section having a cast-in recess and a prior art anchor plate secured therein.

Referring to the drawings, FIG. 2 shows an exemplary cast panel member 10, having a pair of opposed surfaces 18A and 18C, and a second pair of opposed surfaces 18B and 18D, each of the surfaces disposed at right angles to the other. As seen, top surface 18A includes a connection recess therein designated at 17. Connection recess preferably is elliptically shaped although it can be rectangular, square, or even round. As seen, cast panel member 10 includes a longitudinal axis designated at L dissecting the panel member into perfect halves, which necessarily dictates that connection recess 17 will have a left half comprising a left wall surface 19L and a right wall surface 19R. Permanently suspended within the pre-cast panel 10 and centered within recess 17 is anchor-lifting device 22 which forms a part of lifting system of the invention and will be explained in greater detail below.

Figure 3:
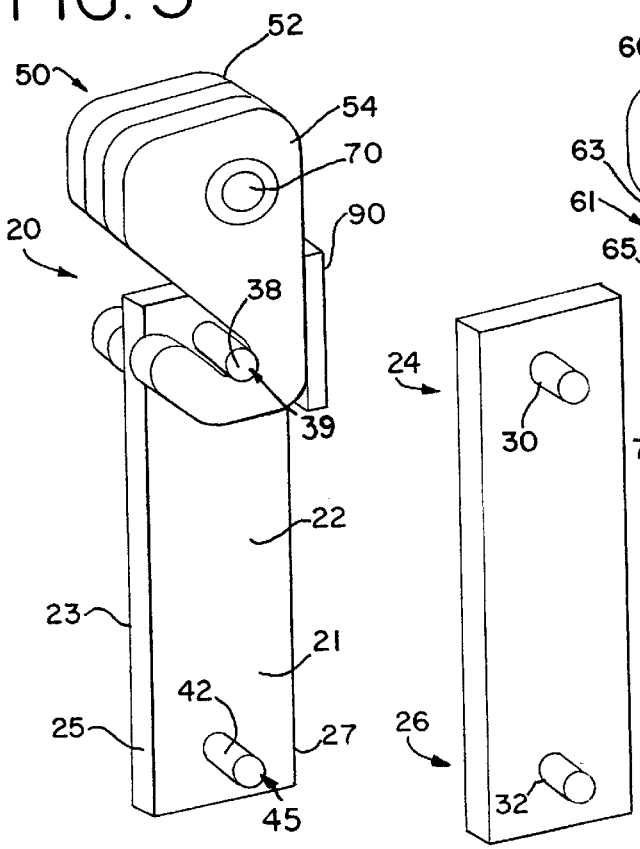
FIG. 3 is an isometric view of a lifting system made in accordance with the present invention.
Figure 4:
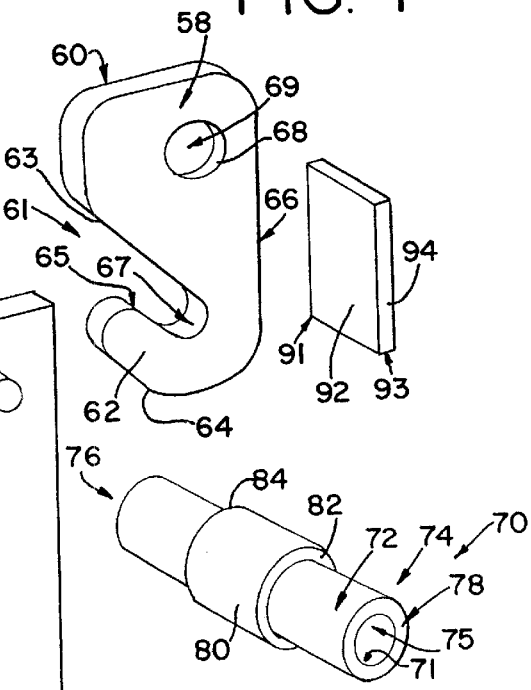
FIG. 4 is an exploded view of the lifting system shown in FIG. 3.
Figure 5:
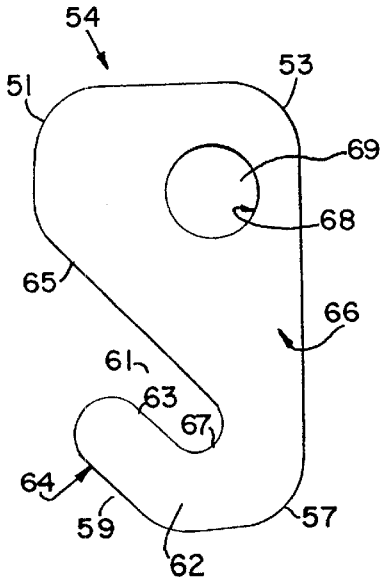
FIG. 5 is a plan view of a lifting hook that is incorporated as part of the lifting system of the present invention.

Turning to FIGS. 3–5, the lifting system of the present invention 20 will now be explained in greater detail. In general, the lifting system 20 is generally comprised of an anchor-lifting device 22 which includes top connection pin 36 and bottom connection pin 40. Attached about top connection pin 36 on each side of anchor-lifting device 22 is a connecting apparatus 50 which is comprised of a left-side hook 52, and a right-side hook 54, interconnected by coupler member 70. Each of the hooks 52, 54 are rigidly attached together by a stop plate 90 welded to both hooks 52, 54, and by a coupler member 70, which is also welded to each hook along the point of connection between the hook and coupler.

Figure 4A:
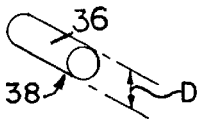
FIGS. 4A and 4B are of pins used in the lifting system.
Figure 4B:
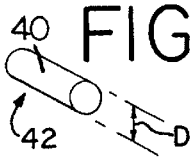

As FIG. 2 depicts, the anchor-lifting device 22 is suspended within cast member 10, and as FIG. 3 best exemplifies, device 22 is comprised of a generally planer, elongate member made from a piece of steel flat bar stock, having a top end 24 and a bottom end 26, each end including an identical hole 30, 32. Furthermore, it is seen that each hole is provided with a respective connection pin 36, 40 which is connected to anchor-lifting device 22 by interference press fitting each pin into a respective hole. Each hole 30, 32 and respective pin 36, 40 is vertically aligned with respect to the other, and is generally centered between minor sides 25 and 27. As best seen in FIGS. 4A, 4B, pin 36 has a outside surface 38 which defines a pin diameter designated at D, and likewise, bottom connection pin 40 has an outside surface 42 which defines an identical diameter designated also at D. Once each pin is inserted, there is a left side portion and right side portion that projects away from a respective major side 21 or 23 to a like extent.

Either end 24 or 26 can be inserted into pre-cast panel member 10 during casting, such that one of the ends will project outwardly from the main body of panel 10 and into connection recess 17. One important aspect of this invention is that the anchor-lifting device 22 is of a symmetrical construction so that when the device is permanently set within the cast panel member 10, a costly mistake will not occur from the wrong end being permanently set within the cast panel member. In the prior art anchoring devices, the anchor plates were not symmetrically designed, and it was common for the non-designated lifting end to be exposed within the connection recess, such that the lifting system was rendered useless because of the cable attachment end being permanently buried in the panel. As mentioned, the preferred embodiment includes a top and a bottom pin for symmetry reasons, although it is possible to only provide the top hole 30 and pin 36, as long as the top pin 36 is exposed when the anchor-lifting device 22 is attached to panel member 10. Furthermore, it should be realized that anchor-lifting device 22 could be attached to panel 10 by other methods, rather than solely embedding the device within the cast member.

Also seen in FIGS. 3 and 4 is the connecting apparatus 50, which represents another member of the lifting system of the present invention. FIG. 3 shows apparatus 50 engaged with top connecting pin 36, straddling both major sides 21, 23 of anchor-lifting device 22. Because each hook 52, 54 is identical to the other, only the details of right hook 54 will be provided herein, although the description will equally pertain to left hook 52. As seen, hook 54 is a generally rectangularly-shaped member having an outside surface 58 and an inside surface 60 and includes a top left portion 51 that is configured with a rounded corner, a top right portion 53 having a rounded corner, a bottom right portion 57 also having a rounded corner, and a bottom left portion 59. The bottom left portion 59 includes a diagonally disposed engagement channel 61 which forms lifting arm 62 that is parallel to channel 61. Channel 61 defines long surface 63, short surface 65 and the radial surface 67 at the apex of the long and short surfaces 63, 65. When the connecting apparatus 50 is mated about device 22, the engagement channel 61 is closely fitted about connection pin 38. The radius for surface 67, is most advantageously sized to match the radius and diameter of the pin 36, 40. This means that the width of engagement channel 61, or the distance between surfaces 63 and 65, is slightly larger than pin diameter D. The hooks 52 and 54 are preferably formed by using a plasma cutter to form the peripheral edges and corners. However, the engagement channel 61, as well as pins 36, 40, are machined so that very tight tolerances between the pins and channel are maintained. In this way, the hooks will not be capable of laterally rocking on the connection pin 36 during lifting of the panel. As a matter of integrity, should the tolerances begin to grow, the connecting apparatus will be prone to laterally rocking on the exposed pin, as well as easygoing rotation, signifying that the connecting apparatus should be discarded. It is also seen that arm 62 includes outside surface 64 which has a role in preventing rotational movement around pin 38 when panel 10 is being lifted. The details of that function will be explained later herein. Hook 54 also includes a hole near the top right portion 53, the hole being defined by surface 68.

FIG. 4 also clearly shows a coupler member 70 which maintains a lateral spacing between each of the hooks 52, 54 in order for the connection apparatus 50 to accept anchor-lifting device 22 therebetween when connecting apparatus 50 is secured about the left and right sides of pin 38. Coupler 70 has an outside wall surface 72 and an interior space 75 which defines an interior wall surface 71. The interior space 75 extends completely through coupler 70 from one end 74 to the other end 76. Instead of each end terminating with a planar surface, each end 74, 76 is provided with a flared transition surface 78, thereby providing a smooth surface area between inside surface 71 and outside wall surface 72. The function of the flared transition surface is to provide a greater force-distribution surface area for a lifting cable which is inserted through interior space 75 when the panel 10 is to be lifted. It should be understood by viewing FIG. 3, that when each hook 52 and 54 is connected to coupler 70, the ends 74, 76 do not project beyond hook outside face 58. The coupler 70 as seen in FIG. 4, also includes an annular upraised land 80 disposed about the midpoint between ends 74, 76. The longitudinal extent of annular land 80 determines the spacing between each hook 52 and 54, which can be made to vary in direct relation to the chosen thickness of the flat bar stock that is used for constructing anchor-lifting device 22. The ends of the annular land 80 form a shoulder 82 on the side of the coupler associated with end 74 and a shoulder 84 on side associated with end 76. When each hook is slid over coupler 70 and received in hole 69, the outside surface of wall 72 is in close tolerance to surface 68 of hole 69. Furthermore, the shoulders 82 and 84 present a stop surface for each hook, whereby a respective inside surface 60 on each hook will abut against a respective shoulder 82 or 84. The holes 69 of each hook, as well as the coupler member 70 are machined in order to maintain very close tolerances in order to avoid creating load imbalances during lifting, and hence, unbalanced stressing within each hook.

As best seen in FIG. 3, each hook 52, 54 will be joined to a stop plate 90 along a back surface 66 on each respective hook. The stop plate 90 includes front face 92 and back face 94. The front face 92 of stop plate 90 is abutted against back surface 66 and then a weldment bead is applied along an edge surface of plate 90 and along back surface 66, thereby securing the stop plate 90 to each of the hooks. The hooks cannot rotate about coupler 70 once the plate is welded thereto. The corner 91, 93 do not extend beyond respective outside surface 58 on each hook once plate 90 is attached.

In operation, when the connecting apparatus 50 is engaged with anchor-lifting device 22 within connection recess 17, the outside surface 64 of arm 62 on each hook 52, 54, will rest against at least the portion of the wall surface defining connection recess 17. Likewise, each corner 91, 93 of plate 90 will also contact at least a portion of the surface defining connection recess 17. This aspect of the invention becomes very important during a lifting operation of panel 10 because typically, once a panel is lifted, it will have a tendency to rotate along longitudinal axis L. Because the present invention provides the engineered hook 52, 54 as well as the stop plate 90, the panel 10 will not be able to rotate as readily about longitudinal axis L because the stop plate 90 in conjunction with the outside surface of arm 62, will hit the inside wall surfaces forming connection recess 17, thereby opposing rotational movement. This feature is seen as an important safety-related improvement over prior art devices which did not prevent rotational movement of the panel during the lifting process. Another important aspect of the invention, concerns the flared transitional surface 78 on each end of coupler 70. In this respect, it should be understood that because the flared surface is provided, the lifting cable which is inserted through the interior space 75 does not rest against a corner and create a point-loaded condition. Rather, the smooth transition between the inside surface 71 and the outside surface 72 provides a distributed lifting load across a large, flared surface 80, thereby reducing the wear on the lifting cable, while simultaneously reducing stress concentration points on the cable and coupler.

As noted, the present invention has found particular application in lifting pre-cast concrete panels. It could readily be adapted to other constructs and objects to be lifted. Furthermore, while the anchor device is described as permanently affixed within a recess in the preferred embodiment, it need not be, although this is not considered most advantageous. Moreover, the anchor device could extend beyond the adjacent surface of the object it is to lift, although once again, this is presently not considered as most desirable in the described environment.

While the apparatus and methods herein disclosed form preferred embodiments of this invention, this invention is not limited to those specific apparatus and methods, and changes can be made therein without departing from the scope of this invention which is defined in the appended claims.

I claim:

1. A lifting system for use in a pre-cast panel having an end surface which includes a connection recess formed therein, the connection recess defined by a continuous surface having sides, comprising:

an anchor-lifting device permanently suspended in the pre-cast panel within the connection recess, said anchor-lifting device including a planar base member and one or more connection pins positioned transversely through said planar base member; and a connecting apparatus for releasable engagement with said one or more connection pins to lift the pre-cast panel, said connecting apparatus comprised of a lifting hook, said lifting hook comprised of two laterally-separated hooks, each of said laterally-separated hooks joined together by a shared coupler and a shared stop plate, said shared coupler having an inside coupler surface and an outside coupler surface, a pair of ends and an interval cavity extending therebetween, each of said pair of ends having a flared transitional surface extending between said inside coupler surface and said outside coupler surface, and further, said lifting hook having a lifting arm which defines an engagement channel, said engagement channel receiving one of said one or more connection pins when engaged therewith, said lifting arm holding said one or more connection pins during a lifting of the pre-cast panel.

2. The lifting system of claim 1, wherein each of said laterally-separated hooks has an inside hook surface and an outside hook surface and each of said pair of ends of said shared coupler is coextensive with a respective said outside hook surface.

3. A lifting system for use in a pre-cast panel having an end surface which includes a connection recess formed therein, the connection recess defined by a continuous surface having sides, comprising:

an anchor-lifting device permanently suspended in the pre-cast panel within the connection recess, said anchor-lifting device including a planar base member and one or more connection pins positioned transversely through said planar base member; and a connecting apparatus for releasable engagement with said one or more connection pins to lift the pre-cast panel, said connecting apparatus comprised of a lifting hook, said lifting hook comprised of two laterally-separated hooks, each of said laterally-separated hooks joined together by a shared coupler and a shared stop plate, said shared stop plate being welded across each of said laterally-separated hooks on a respective back side, adjacent a bottom portion of each of said laterally-separated hooks, and further, said lifting hook having a lifting arm which defines an engagement channel, said engagement channel receiving one of said one or more connection pins when engaged therewith, said lifting arm holding said one or more connection pins during a lifting of the pre-cast panel.

4. A connecting apparatus for use with lifting a heavy pre-cast panel member, the pre-cast panel member having a top surface which includes a connection recess formed therein, the connection recess defined by a recess surface including a bottom wall surface and at least one interconnecting side wall surface, the connection recess generally centered along a longitudinal axis of the top surface and including therein, an upstanding anchor-lifting device permanently embedded in the pre-cast panel member, the upstanding anchor-lifting device presenting one or more connection pins transversely disposed to the longitudinal axis, the connecting apparatus comprising:

a first lifting hook and a second lifting hook, each said first lifting hook and second lifting hook having a lifting arm formed at one, lower corner thereof, and a hole formed at an upper, diagonally opposite corner, said lifting arm defining an engagement channel; and a coupler having an inside surface and a cylindrical outside surface, wherein said coupler is inserted into each said hole of said first lifting hook and second lifting hook, said coupler having a first end and a second end and a centrally disposed interior space extending between said first end and said second end, each said first end and said second end having a flared transitional surface formed between said inside surface and said cylindrical outside surface, each said transitional surface coextensive with an outside surface of each said first lifting hook and said second lifting hook.

5. The connecting apparatus of claim 4, wherein said coupler includes an upraised land formed about a midpoint between said first end and said second end, said upraised land having a predetermined longitudinal extent which corresponds to a lateral spacing between said first lifting and said second lifting hook.

6. The connecting apparatus of claim 5, wherein said land presents a pair of shoulders, each of said pair of shoulders contacting a respective inside surface of each of said first lifting hook and said second lifting hook when said first lifting hook and said second lifting hook are connected to said coupler by sliding each said first end and said second end of said coupler through each said hole formed in each said first lifting and said second lifting hook.

7. The connecting apparatus of claim 4, wherein each said engagement channel is defined by a long surface and an opposed short surface, a distance between said long surface and said short surface being about the same as said diameter of said one or more connection pins.

8. The connecting apparatus of claim 4, wherein each said lifting arm upwardly extends towards the top surface of the pre-cast panel member when said first hook and said second hook is secured about said one or more connection pins.

9. The connecting apparatus of claim 4, further including a shared stop plate attached to a back side of each said first lifting hook and said second lifting, said shared stop plate having a pair of opposing corners that do not project beyond an outside surface of each said first lifting hook and said second lifting hook.

10. The connecting apparatus of claim 9, wherein said pair of opposing corners of said stop plate contacts the recess surface of the connection recess when the connecting apparatus is secured to said one or more connection pins.

* * * * *